US008381826B2

(12) United States Patent
Al-Azemi

(10) Patent No.: US 8,381,826 B2
(45) Date of Patent: Feb. 26, 2013

(54) FIRE FIGHTING ROBOT

(76) Inventor: Hadi A. Al-Azemi, Daher (KW)

( * ) Notice: Subject to any disclaimer, the term of this patent is extended or adjusted under 35 U.S.C. 154(b) by 263 days.

(21) Appl. No.: 12/748,845

(22) Filed: Mar. 29, 2010

(65) Prior Publication Data

US 2011/0232925 A1 Sep. 29, 2011

(51) Int. Cl.
*A62C 27/00* (2006.01)

(52) U.S. Cl. ..... 169/52; 169/70; 169/54; 169/51

(58) Field of Classification Search ..... 169/46, 169/52, 24, 62, 68, 51, 70, 54
See application file for complete search history.

(56) References Cited

U.S. PATENT DOCUMENTS

| | | | | |
|---|---|---|---|---|
| 3,724,554 | A * | 4/1973 | Rupert et al. | 169/52 |
| 4,621,562 | A | 11/1986 | Carr et al. | |
| 5,295,890 | A * | 3/1994 | Myers | 446/176 |
| 5,440,916 | A | 8/1995 | Stone et al. | |
| 6,113,343 | A * | 9/2000 | Goldenberg et al. | 414/729 |
| 6,431,296 | B1 * | 8/2002 | Won | 180/9.32 |
| 6,473,004 | B1 * | 10/2002 | Smull | 340/984 |
| 6,899,189 | B2 * | 5/2005 | Overlach et al. | 180/9.1 |
| 6,929,072 | B2 * | 8/2005 | Brown | 169/46 |
| 7,182,144 | B2 | 2/2007 | Baba et al. | |
| 7,264,062 | B1 * | 9/2007 | Ham | 169/52 |
| 7,565,941 | B2 * | 7/2009 | Cunningham | 180/167 |
| 2004/0089458 | A1 * | 5/2004 | Jones | 169/24 |
| 2006/0178085 | A1 * | 8/2006 | Sotereanos et al. | 446/456 |

* cited by examiner

*Primary Examiner* — Len Tran
*Assistant Examiner* — Viet Le
(74) *Attorney, Agent, or Firm* — Richard C. Litman

(57) ABSTRACT

A fire fighting robot including a frame assembly and a fire extinguishing mechanism disposed on or within the frame assembly for ejecting a fire suppressant onto a fire. The robot also includes a caterpillar type of drive including a left and a right endless metal belt or track with an independent drive unit on each side of the robot. The left and the right motor are provided for rotating the endless belts to move the robot in a forward or rearward direction. Retractable illumination and video means for displaying a remote image of the area around the robot are provided. The robot also includes a mechanism for connecting the fire extinguishing mechanism to a source of water or other fire suppressant and for positioning a stream of suppressant onto a fire. In addition, the robot includes a pair of cooling fans and sprinkler system for maintaining the robot at an acceptable temperature.

1 Claim, 3 Drawing Sheets

FIRE FIGHTING ROBOT

FIELD OF THE INVENTION

This invention relates to a fire fighting robot with a caterpillar drive assembly including a left and right drive unit and an engine for each drive unit.

BACKGROUND FOR THE INVENTION

Mobile self-contained and remote controlled robots capable of safely operating in a surrounding combustible atmosphere are known and have been used in hazardous environments and for handling explosives. For example, an emergency response mobile robot for operation in combustible atmospheres is disclosed in a U.S. Pat. No. 5,440,916 of Stone et al. As disclosed therein, the robot includes a non-sparking and non-arcing electro-mechanical and electronic components designed to preclude igniting a combustible atmosphere and incorporates a positively pressurized enclosure that houses the electro-mechanical and electronic components of the robot to prevent intrusion of the combustible atmosphere into the enclosure. The robot also has a sensing device for determining the type of combustible substance in the surrounding atmosphere as well as the concentration of various substances.

A more recent patent of Goldenberg et al., U.S. Pat. No. 6,113,343 discloses a robot especially adapted for use in hazardous environments and particularly adapted for explosive disposal. The robot includes a wheeled platform carrying a winder mechanism which ensures that the remote control cable will not be fouled by the robot or its attachments. Coaxial with the winder mechanism is a turret mechanism that can rotate indefinitely and which carries thereon a manipulator arm section which includes a first arm pivotable to about 110 degrees and which carries thereon a second arm which is pivotable through about 120 degrees and carries a bulkhead to which any of a plurality of end effectors can be connected by way of a quick connect and disconnect mechanism. The end effectors include a set of links having different lengths, one or two extension lengths, a wrist and gripper mechanism, an aiming and disrupter mechanism and a relocatable surveillance camera. The robot is capable of controlled movement to or from a hazardous site; maneuvering the wrist and gripper mechanism or the aiming and disrupter mechanism by means of the manipulator arm into close proximity to either move or destroy a target. Rugged, zero-backlash joints blend precision and power for the end effectors to perform delicate, or not so delicate, operations. The wrist and gripper mechanisms in combination with any or all of the extension links allows dextrous operations to be performed easily, even for an untrained operator. The robot is compact, highly maneuverable, relatively inexpensive, and meets the requirements of law enforcement, military and environmental agencies having a need for such a device.

Further, a U.S. patent of Baba et al., U.S. Pat. No. 7,182,144 discloses a fire-fighting robot that can quickly start to fight a fire occurring in a hazardous location, which is not readily accessible to firefighters. The fire fighting robot is self propelled and remote-controlled via wireless or mobile communications to fight a fire. The robot includes one or more fire extinguisher storage portions for storing fire extinguishers which provide a jet of a fire fighting agent from a jet outlet by depressing a lever, a jet control portion disposed in the fire extinguisher storage portion for depressing the lever, and a jet outlet securing portion for detachably securing the jet outlet of the fire extinguishers.

Notwithstanding the above, it is presently believed that there is a need and a potential commercial market for an improved fire fighting robot in accordance with the present invention. There should be a need and a potential market for such devices because they will preserve the lives of firefighters, reduce the risk of injuries and enable firemen to extinguish fires in a hazardous location from a remote area and at the same time eliminate human exposure to smoke and harmful fumes. In addition to the above, a robot in accordance with the present invention is capable of moving a water cannon in all directions and to bring it into close proximity to a fire, can direct water and other suppressants onto a fire and include video means to view places that may be obscured by smoke, dust etc. The robot also includes a spray cooling to avoid damage to the robot due to excess heat and contains means for expulsion of water due to leaks in the system.

BRIEF SUMMARY OF THE INVENTION

In essence the present invention contemplates a fire fighting robot comprising or consisting of a frame assembly, a fire extinguishing mechanism disposed within the frame assembly and an outer housing enclosing the fire extinguishing mechanism with the exception of an outwardly extending nozzle or water cannon. The robot also includes a caterpillar drive assembly including a left caterpillar drive unit including a left engine for rotating said left caterpillar in a forward and rearward direction and a right caterpillar drive unit and a right engine for rotating said right caterpillar drive unit in a forward and/or a reverse direction. In addition the robot includes first remote control means for controlling the engines to thereby position the robot with respect to a fire, illumination means and video means for displaying an image of the area around said robot at a remote location and means for cooling the interior and exterior of said robot as well as a second remote control means for directing a flow of fire suppressant onto a fire.

The invention will now be described in connection with the accompanying drawings wherein like reference numerals have been used to indicate like parts.

DESCRIPTION OF THE PREFERRED EMBODIMENTS OF THE INVENTION

Figure 1:
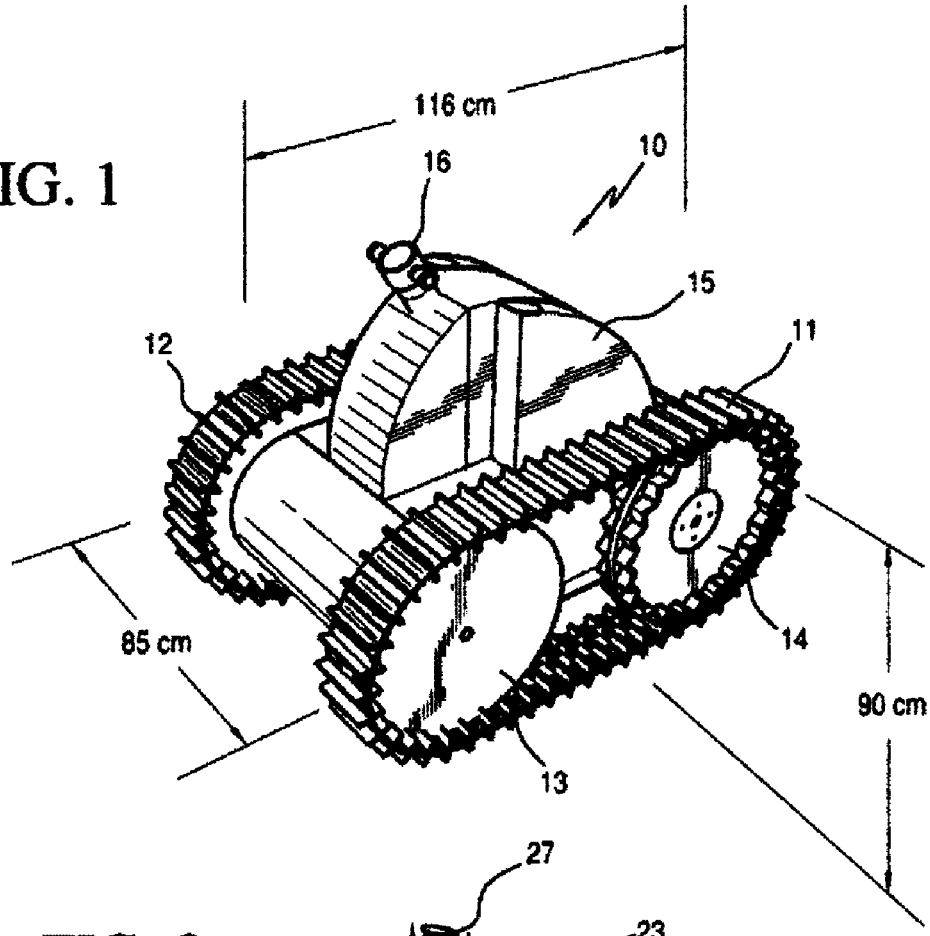
FIG. 1 is a perspective view of a fire fighting robot in accordance with the present invention.
Figure 2:
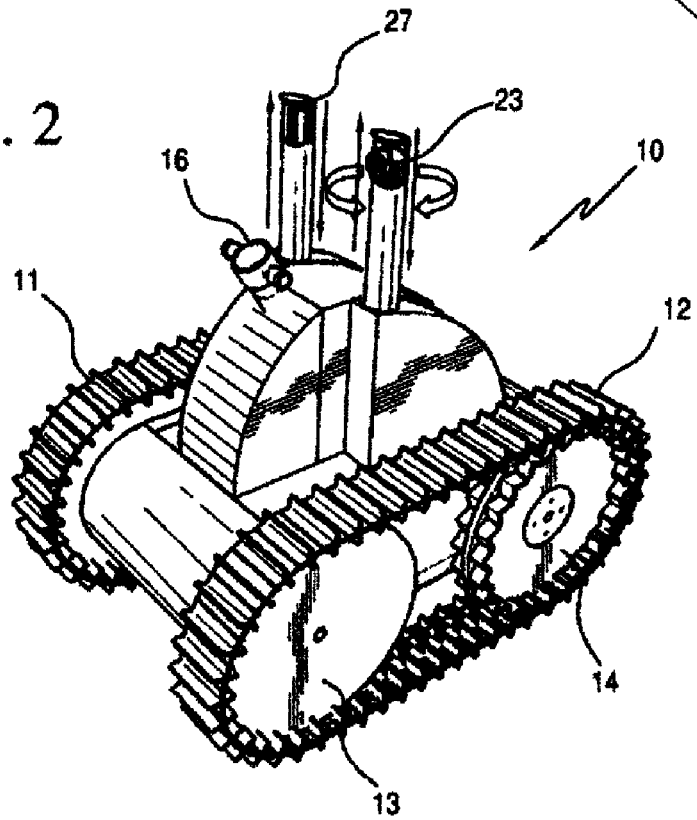
FIG. 2 is a perspective view of the fire fighting robot shown in FIG. 1 but with the illumination and video means in an extended position.
Figure 5:
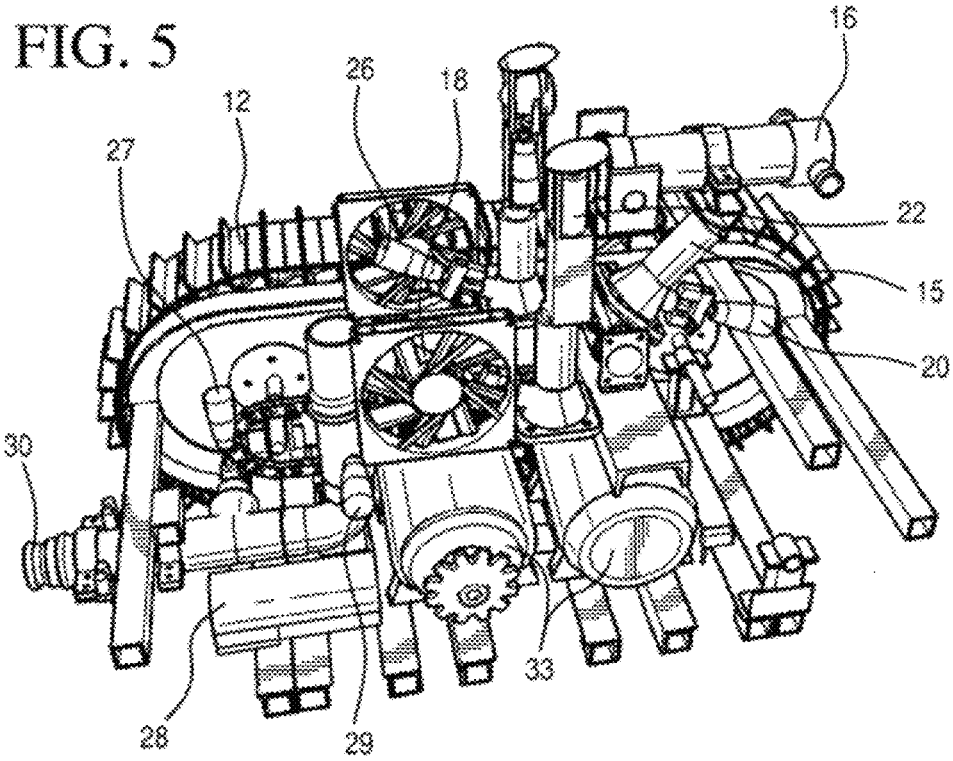
FIG. 5 is a perspective view illustrating the right caterpillar unit and rear connector for water or other fire suppressants.

A fire fighting robot 10 as shown in FIGS. 1 and 2 has a length of about 116 cm, a width of about 85 cm and a height of about 90 cm and includes a pair of caterpillar type drive units which include endless metal belts 11 and 12 and drive wheels 13 and 14 (FIGS. 1 & 2) and 13' 14' as shown in FIG. 5. The robot 10 also includes an outer housing 15 of galvanized steel or the like with a thickness of about 1.5 mm. As shown in FIGS. 1 and 2 a moveable nozzle 16 extends outwardly from an upper forward portion of the housing 15 but can be moved up or down to direct water or other fire suppressant onto a fire. As illustrated in FIG. 2 the robot 10 also includes a light 17 and video means such as a camera 23 that can be extended upwardly to indicate the location of the robot and to show the area around the robot 10 as for example by rotating the camera about a vertical axis.

Figure 3:
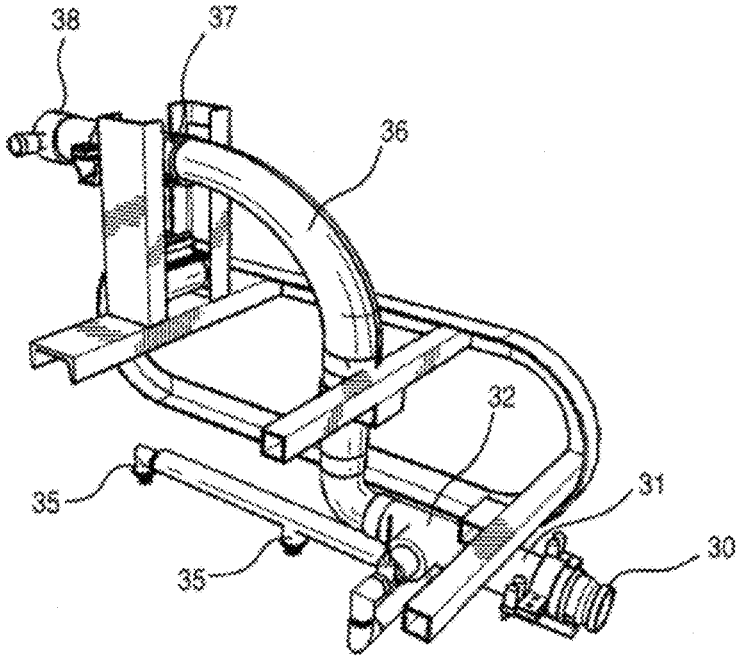
FIG. 3 is a perspective view of a water ejecting system as used in the present invention.

As illustrated in FIG. 3 water for suppressing a fire is delivered to a male coupling 30 through a suitable hose (not shown) and into a 2/12" water pipe 31 and T-shaped connector 32. The T-shaped connector 32 conveys a majority of the water to a 3" hose 33 and nozzle 34. The T-shaped connector 32 also directs a lesser amount of water to sprinklers 35 for cooling the outer surface or housing of the robot 10. The sprinklers may be connected through rubber hoses (not shown) to provide water to different areas of the housing to cool the outer surface of the housing.

The main volume of water is fed upwardly through a three inch hose 36 through a transfer 37 to a coupling 38. The coupling 38 is coupled to a nozzle or water cannon (not shown in FIG. 3).

Figure 4:
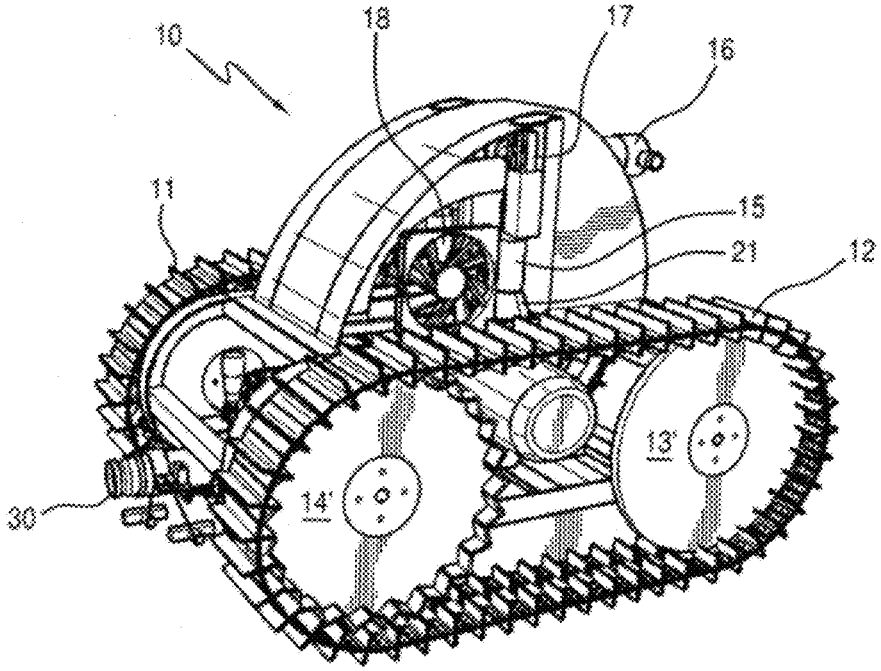
FIG. 4 is a side view partially broken away to eliminate the drive mechanism and water ejecting system included in the present invention.

FIG. 4 is a further illustration of the robot 10 partially broken away to show the interior thereof. For example, a jack 15 is used to elevate the nozzle 16 while a first fan 18 is used to cool the interior of the robot. The metal track 12 and drive wheels 13' and 14' are also shown.

Figure 6:
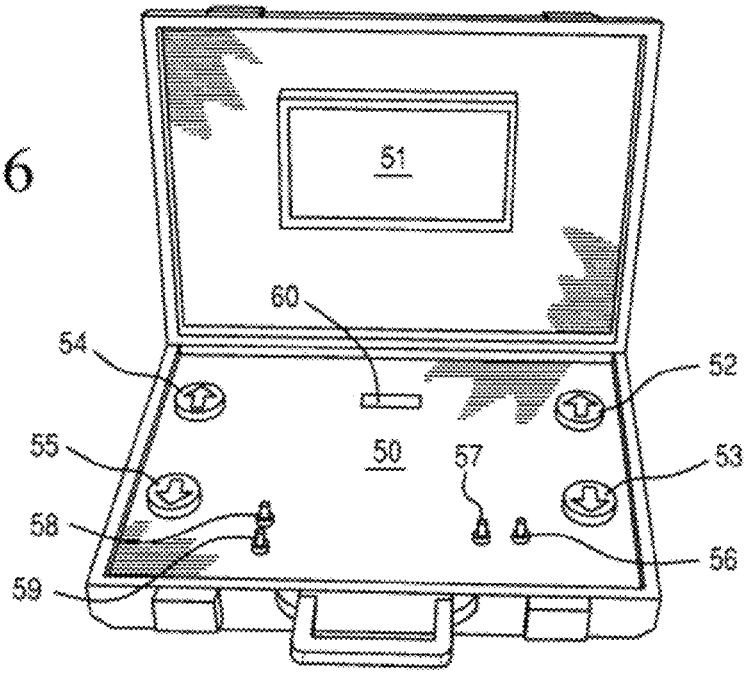
FIG. 6 is a perspective view taken from the top to illustrate a controller and monitor for controlling and monitoring a robot in accordance with the present invention.

An interior view of the robot 20 is shown in FIG. 5 wherein a pair of engines 33 each with a capacity to pull 2½ tons are disposed in a lower part of the robot 10 for moving the metal track 12 and a $2^{nd}$ metal track (not shown in FIG. 6). An electric screw 21 is also provided to move the hydraulic jack 15 up or down to direct water from the nozzle 16 onto a fire.

As shown an alerting bulb 22 such as a flashing light is provided to keep track of the robot during the evening or during periods of excessive smoke. The alerting bulb can be replaced by a small flood lamp for illuminating the area around the robot. A camera or video 23 is also provided for viewing the area and the vicinity of the robot from a remote location. A first cooling fan 18 and second cooling fan 26 are provided to cool the interior of the robot.

In addition, the electric screw 21 opens and closes the sprinklers for cooling the exterior of the robot 10 while a pump 28 automatically expels water from inside of the robot as for example due to leakage.

FIG. 6 illustrates a control panel 50 and monitor 51 for controlling and tracking a robot in accordance with the present invention from a safe or relatively remote location. The panel 50 and monitor 51 are shown in the form of a briefcase that can be easily transported to different locations and readily moved from one vantage point to another.

The control panel 50 includes a pair of actuating buttons 52 and 53 that include an arrow on a top surface thereof for moving the right engine (not shown in FIG. 6) in a forward or rear direction. Actually, the right engine moves a right side metal track to move the robot forward or rearwardly or to pivot the robot if the other track is not moved simultaneously. Similarly buttons 54 and 55 that also include arrows from the top surface thereof and which are disposed on the opposite side of the control panel 50 are provided to actuate the left side motor and track to move the left side forward or rearward or pivot the robot in the same manner as previously stated with respect to buttons 52 and 53.

In a preferred embodiment of the invention moving the robot in a forward direction opens the water valve to pump water onto a fire while moving the robot in the reverse direction will shut off the water. Also, if the buttons advance the robot it opens the sprinklers for cooling the robot and if moved back automatically shuts off the sprinklers for cooling the exterior of the robot. Separate buttons 55 and 56 are provided for overriding the automatic application of water for a fire or for cooling the robot.

A button or switch 57 activates a lamp by elevating the lamp and turning the lamp on or deactivating the lamp and allowing it to move downward into a recess. An additional button 58 is provided to move a camera or video monitor into an activated position or deactivated position into a recess in the robot. A control button 59 is used to rotate the camera to the left or right.

The control panel 50 also includes a small screen 60 that includes a digital read out as an indication of the temperature in the area of the robot. The cover of the briefcase includes a 7 inch monitor 51 that allows a remote individual to monitor the area around the robot.

While the invention has been described in connection with its preferred embodiment it should be recognized and understood that changes and modifications may be made therein without departing from the scope of the appended claims.

What is claimed is:

1. A fire fighting robot consisting of:

a frame assembly, a housing and a fire extinguishing mechanism disposed on said frame for ejecting a fire suppressant onto a fire;

a caterpillar drive assembly including a left caterpillar drive unit, a left engine for rotating said left caterpillar drive unit in a forward and rearward direction and a right caterpillar drive unit and a right engine for rotating said right caterpillar drive unit in a forward and rearward direction and a first remote control means for controlling said engines to thereby position said robot with respect to a fire;

a sprinkler for cooling said robot;

wherein moving the robot in a forward direction opens a water valve to pump water onto a fire and moving the robot in a reverse direction shuts off the flow of water, and if the robot moves forward, it opens a sprinkler for cooling the robot and when it moves in reverse it stops the flow of water;

illumination means and video means for displaying an image of an area around said robot at a remote location and means for cooling the interior and exterior of said robot; and second remote control means for controlling a nozzle and means for raising and lowering said nozzle for directing a flow of fire suppressant onto a fire; in which said robot has a length of about 116 cm, a width of about 85 cm and a height of about 90 cm; and which includes an outer housing and in which said camera is rotatable about a vertical axis and is retractable into said outer housing; and wherein said cooling means includes a water sprinkler for cooling an exterior surface of the robot and a pump for removing any accumulated liquid from the interior of said housing.

* * * * *